US007717153B2

(12) United States Patent
Gramsch

(10) Patent No.: US 7,717,153 B2
(45) Date of Patent: May 18, 2010

(54) DRIVE UNIT FOR A VERTICAL VENETIAN BLIND

(75) Inventor: Wilfried Gramsch, Beverstedt (DE)

(73) Assignee: VKR Holding A/S, Soborg (DK)

( * ) Notice: Subject to any disclaimer, the term of this patent is extended or adjusted under 35 U.S.C. 154(b) by 311 days.

(21) Appl. No.: 11/748,763

(22) Filed: May 15, 2007

(65) Prior Publication Data

US 2007/0267154 A1 Nov. 22, 2007

(30) Foreign Application Priority Data

May 16, 2006 (DE) ..... 10 2006 023 789
Jan. 10, 2007 (DE) ..... 20 2007 000 605 U

(51) Int. Cl.
*E06B 9/36* (2006.01)

(52) U.S. Cl. ..... 160/168.1 V; 160/173 V; 160/176.1 V; 160/177 V; 160/178.1 V

(58) Field of Classification Search ..... 160/168.1 V, 160/173 V, 176.1 V, 177 V, 178.1 V
See application file for complete search history.

(56) References Cited

U.S. PATENT DOCUMENTS 3,463,219 A * 8/1969 Osterholz ..... 160/172 R
3,878,877 A * 4/1975 Bruneau et al. ..... 160/168.1 R
4,316,493 A * 2/1982 Arena ..... 160/168.1 V
5,749,406 A 5/1998 Benthin
5,771,953 A * 6/1998 Benthin ..... 160/168.1 V
5,845,695 A * 12/1998 Cadorette et al. ..... 160/173 V
2007/0267154 A1 * 11/2007 Gramsch ..... 160/173 R

FOREIGN PATENT DOCUMENTS

DE 195 25 139 1/1997

* cited by examiner

*Primary Examiner*—Blair M. Johnson
(74) *Attorney, Agent, or Firm*—McGlew and Tuttle, P.C.

(57) ABSTRACT

A drive unit for a vertical Venetian blind includes a shared driving element (15) for the displacing motion and the rotating motion of vertical slats. A differential gear (13) is provided with a driving element coupled to the shared driving element (15), a first driven element (17) coupled to the first drive means (21) for the rotating motion of the vertical slats, and a second driven element (16) coupled to second drive means for the displacing motion of the vertical slats. Displacing motions and rotating motions of the vertical slats can be driven by the shared driving element (15). A complete closing of the vertical slats is made possible in both directions of rotation and, at the same time, a hooking up of the vertical slats by means of displacing same in an unsuitable rotating position is prevented.

20 Claims, 12 Drawing Sheets

DRIVE UNIT FOR A VERTICAL VENETIAN BLIND

CROSS REFERENCE TO RELATED APPLICATIONS

This application claims the benefit of priority under 35 U.S.C. §119 of German Patent Application DE 10 2006 023 789.7 filed May 16, 2006, and German Patent Application DE 20 2007 000 605.5 filed Jan. 10, 2007, the entire contents of each German Patent Application is incorporated herein by reference.

FIELD OF THE INVENTION

The present invention pertains to a drive unit for a vertical Venetian blind with a shared driving element for the displacing motion and the rotating motion of vertical slats, with a differential gear, whose first driving element is coupled to the shared driving element, whose first driven element is coupled to first drive means for the rotating motion of the vertical slats, and whose second driven element is coupled to second drive means for the displacing motion of the vertical slats.

BACKGROUND OF THE INVENTION

In drive units of this type, both the displacing motion and the rotating motion of the vertical slats are driven by means of the shared driving element. In the meaning of this patent application differential gear is defined here such that a driving element with two driven elements is coupled using gears, so that either both driven elements or, with one driven element fixed, the other driven element are or is driven by means of the driving element. Moreover, by means of a differential gear of this type, it is possible, like in a differential, by fixing one driven element, to achieve a reversal of direction of the other driven element. In drive units of the above-mentioned type, a driving gear for the displacing of the vertical slats is driven, for example, by means of a planet gear as a differential gear. In this case, moreover, a spline shaft for the rotation of the slats is driven via an outer ring on the pinion cage of the planet gear. Since the necessary forces for the rotation of the slats are lower than for the displacing of the slats, when the driving element is actuated, first the necessary rotating motion of the vertical slats is carried out and then the displacing of the vertical slats. In particular, in case of an open vertical Venetian blind, at first the vertical slats are rotated into their closed orientation and then extended in this closed, rotated position for closing the vertical Venetian blind. To open the vertical Venetian blind, the shared driving element is actuated in the opposite direction. Here, the vertical slats again rotate at first into their opposite rotated position because of the lower force that is needed for this. When this opposite rotated position is reached, a stop limits a first rotation, such that the rotating motion and the related first driven element are blocked. With another actuation of the shared driving element, a displacement of the vertical slats takes place by means of the second driven element for the complete opening of the vertical Venetian blind. So that the vertical slats do not now get hooked up in their opposite rotated position with the opening of the vertical Venetian blind, this opposite rotated position is aligned in such a way that complete shading in this opposite rotated position is not possible. However, with different angles of incidence, it would be desirable for the vertical slats to be able to be closed completely in both directions of rotation. Up to now, however, this possibility requires either a separate driving element for the rotating motion or a gear with switching possibilities between rotating motion and displacing motion. A separate driving element for the rotating motion is uncomfortable, since in this case, for example, two ball chains have to be operated and, according to experience, the wrong ball chain is usually actuated. Thus, instead of performing a turning of the vertical slats, a displacing of the slats may be actuated in this case, which, in the closed rotated state, may lead to hooking up of the vertical slats. A switchable gear is in turn complicated and prone to difficulties. Moreover, the actuation of such a switchable gear is possible only with difficulty at unfavorable pulling angles.

SUMMARY OF THE INVENTION

The basic object of the present invention is thus to provide a drive unit for a vertical Venetian blind, with which displacing motion and rotating motion of the vertical slats can be driven by means of a shared driving element, whereby a complete closing of the vertical slats is made possible in both directions of rotation and, at the same time, a hooking up of the vertical slats by means of moving same in an unsuitable rotated position shall be prevented as much as possible.

The object is accomplished in that in a drive unit of the type mentioned above another differential gear is inserted between the first driven element and the first drive means for the rotating motion.

When the vertical slats are rotated into their position necessary for opening the vertical Venetian blind, a reversal of direction can be brought about by means of this other differential gear to the extent that the vertical slats are at first completely rotated in the opposite direction for closing and with further actuation of the shared driving element in the same direction of actuation by means of the other differential gear, the vertical slats are at first again slightly opened, before moving of the vertical slats for opening starts.

One variant of the present invention is characterized in that the other differential gear has another driving element, another first driven element and another second driven element, that the other driving element is coupled to the first driven element, and that the other first driven element is coupled to the first drive means for the rotating motion. In this way, the drive means for the rotating motion can be driven with the other differential gear in a simple and reliable manner. Thus, it is possible for limiting means to be assigned to the other second driving element for limiting the motion of the other second driving element. The limiting means may have, for example, a spiral at the other second driven element and a worm gear assigned to same, which together form a stop for limiting the motion of the other second driven element. Moreover, it is advantageous if the limiting means are embodied such that the rotation range of the vertical slats is limited to 180°. In this way, a complete closing of the vertical slats in both directions of rotation can be achieved by means of actuating the shared driving element.

Another variant of the present invention is characterized in that other limiting means are assigned to the other driving element, which limit the relative motion between the other driving element and the other second driven element. If the motion of the other second driven element is thus hindered in this case by means of the limiting means, it can be guaranteed by means of the other limiting means that the other driving element can still be moved a little bit against the other second driven element. For example, the other limiting means may have another stop each at the other driving element and at the other second driving element. It is then possible that the relative motion between the other driving element and the other second driven element is limited to one revolution by means of the other stops. This embodiment offers the possibility to use the other stops for two discrete stopping positions. In this mode of operation, it is possible that when the shared driving element is actuated, a rotating motion is carried out to the extent that the limiting means prevent another rotation of the vertical slats, whereby, at the same time, the other stops completely block the other differential gear in this position. With another actuation of the shared driving element, a displacing motion of the vertical slats for closing then starts by means of the differential gear. If the shared driving element now in the closed state is actuated in the opposite direction, then the vertical slats are at first rotated in their opposite, closed rotated position by means of the other differential gear, whereby the limiting means in this opposite, closed, rotated position limit another motion of the other second driven element. If the shared driving element is now further actuated in the same direction, then a reversal of direction of the other first driven element takes place because of the blocked other second driven element. By means of the other stops, because of the reversal of direction of the other first driven element, the vertical slats can again be opened to the extent that the other differential gear is blocked by means of the other stops after one revolution between the other driving element and the other second driven element and thus a displacing motion via the differential gear is initiated. The other driving element may be connected to the other second driven element, for example, in a spring-mounted manner. No rigid stopping action occurs in this case. Rather, already with a sufficiently large opening angle of the vertical slats, such that the spring force corresponds approximately to the force needed for displacing, a displacing of the vertical slats can be started. The other driving element may be connected to the other second driven element, for example, by means of an especially pretensioned leg spring.

However, such a spring-mounted connection of the other driving element to the other second driven element may also be considered to be a drawback. On the one hand, malfunction may occur in case of defective coordination of the spring rate or wear or contamination of the mechanism, in which a displacing of the vertical slats already starts, before the springs are already deflected and the vertical slots have thus been rotated into a displaced position. Another advantageous variant arises hereby in that the other driving element is detachably connected to the other second driven element by means of a snap-in coupling. In this case, a spring force does not have to be overcome, but rather it is sufficient to release the snap-in coupling. This can be accomplished, for example, by the snap-in coupling having a radially pretensioned spring section at the other first driven element, which can be released from a coupling position with a release element assigned to the other second driven element. This spring section acts here as a carrier and is pretensioned in its coupling position in such a way that a snap-in connection is reliably produced in the coupling position by means of the spring force, while this snap-in connection is released with the release element when the spring section is released. Furthermore, it is advantageous if the spring section in the coupling position actively meshes with a mount assigned to the other second driven element. By means of this active meshing, for example, a torque can be transmitted from the spring section onto the mount and thus onto the other second driven element. An advantageous embodiment of the release element arises in that a section connected at the spiral can be driven by means of the worm gear when the stop for actuating the release element is reached. In this case, when the stop is reached, the section is actuated in such a way, for example, pressed radially inwards against a spring force, that the spring section is released from the mount, so that the result is an uncoupled position.

Another embodiment of the present invention is characterized in that the first drive means for the rotating motion of the vertical slats have a spline shaft, which is connected to the other first driving element in a manner adapted to rotate in unison. By means of such a spline shaft, a rotating gear in the traveling carriage of the vertical slats can be actuated in the known manner. At the same time, this spline shaft offers the possibility of also being used as a bearing for, for example, a toothed wheel as the other driving element.

Another variant of the present invention is characterized in that the other differential gear is a differential gear. The differential gear here may be a spur planet gear or a bevel planet gear. By means of a differential gear of this type, a reversal of direction can be achieved by fixing the gear housing as the other second driven element.

In another variant of the present invention, the shared driving element actively meshes with a lengthwise extended, endless pulling element. The shared driving element here may be a chain wheel and the pulling element may be a ball chain. In this way, the chain wheel can be actuated as the shared driving element with the ball chain in a reliable and largely slip-free manner.

An advantageous embodiment of the present invention is characterized in that the differential gear is a planet gear, whose central wheel is connected to the shared driving element in a manner adapted to rotate in unison. Consequently, the result is an especially compact design. The planet gear may have an outer ring as the first driven element, which meshes with the other driving element. The outer ring may be arranged, for example, at a planet carrier. In this case, a good gearing can be achieved, so that at first a rotation of the vertical slats takes place when the shared driving element is actuated.

Moreover, it is possible for the second driven element to be actively connected to a driving gear for a pull cord, especially a ball chain, for displacing the vertical slats. If this pull cord is connected, for example, to the first carriage for the vertical slats, a reliable displacement with low exertion of force can thus be guaranteed in a simple manner and with little space requirement.

Another variant of the present invention pertains to a vertical Venetian blind with a drive unit having the features of the present invention. With such a vertical Venetian blind, shading can be brought about at any angles of incidence in a simple manner and without the risk of error on the part of the operator.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
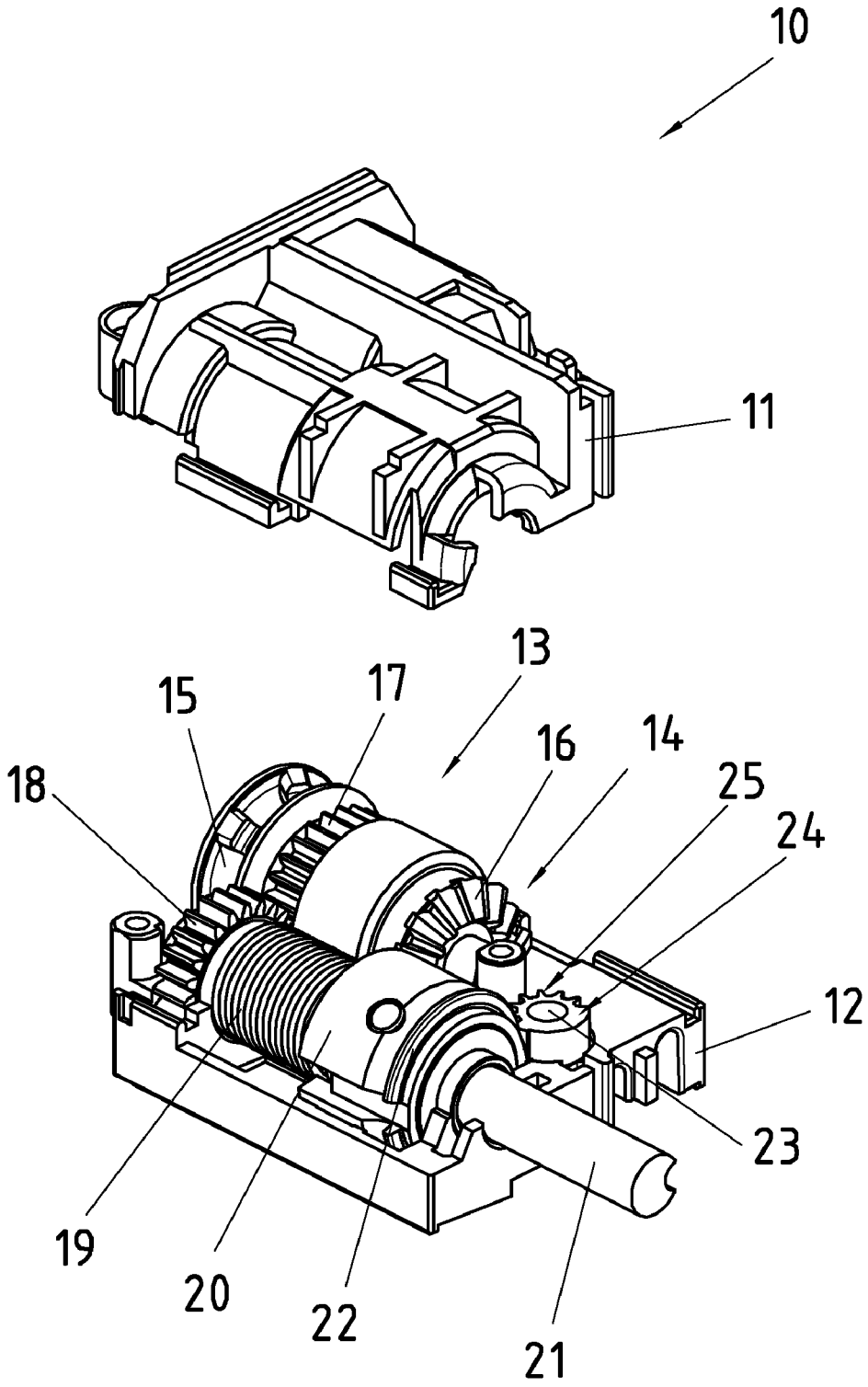
FIG. 1 is an exploded a schematic view of a drive unit having the features of the present invention with open housing.

Referring to the drawings in particular, FIG. 1 shows a schematic view of a drive unit 10 with the features of the present invention. The drive unit is used for driving a vertical Venetian blind not shown in FIG. 1. The drive unit 10 has an upper housing part 11 and a lower housing part 12, wherein in FIG. 1 the upper housing part 11 is shown removed from the lower housing part 12.

As can be inferred from FIG. 1, a differential gear 13 and another differential gear 14 are mounted at the lower housing part 12. In particular, the differential gear is a planet gear 13 and the other differential gear is a differential gear 14. The planet gear 13 and the differential gear 14 have a shared actuating element 15, namely a chain wheel 15. In the exemplary embodiment shown, the chain wheel 15 is connected to a central wheel (not shown in FIG. 1) of the planet gear 13 in a manner adapted to rotate in unison.

The planet gear 13 has a first driven element 17 and a second driven element 16. The first driven element 17 in this embodiment is an outer ring 17 on the outer circumference of the planet gear 13, namely on the planet carrier, and the second driven element 16 is a bevel gear 16.

As can be further inferred from FIG. 1, a toothed wheel 18 meshes with the outer ring 17. The toothed wheel 18 is used as the other driving element for the differential gear 14. For this purpose, the toothed wheel 18 is connected to a bevel gear (not shown in the figure) of the differential gear 14 in a manner adapted to rotate in unison. Moreover, the toothed wheel 18 is connected by means of a leg spring 19 to a bushing 20 of the differential gear 14, as is explained in detail below. The bushing 20 is used as the housing of the differential gear 14. A spline shaft 21 extends through the differential gear 14 and the toothed wheel 18 and is connected to a bevel gear (not shown FIG. 1) of the differential gear 14 as the other first driven element. The bushing 20 has a spiral 22 on its outer circumference as the other second driven element of the differential gear 14.

Meshing with the spiral 22, a stop element 24 is pivotably arranged about an axle 23. The stop element 24 has a toothed ring section 25.

Figure 2:
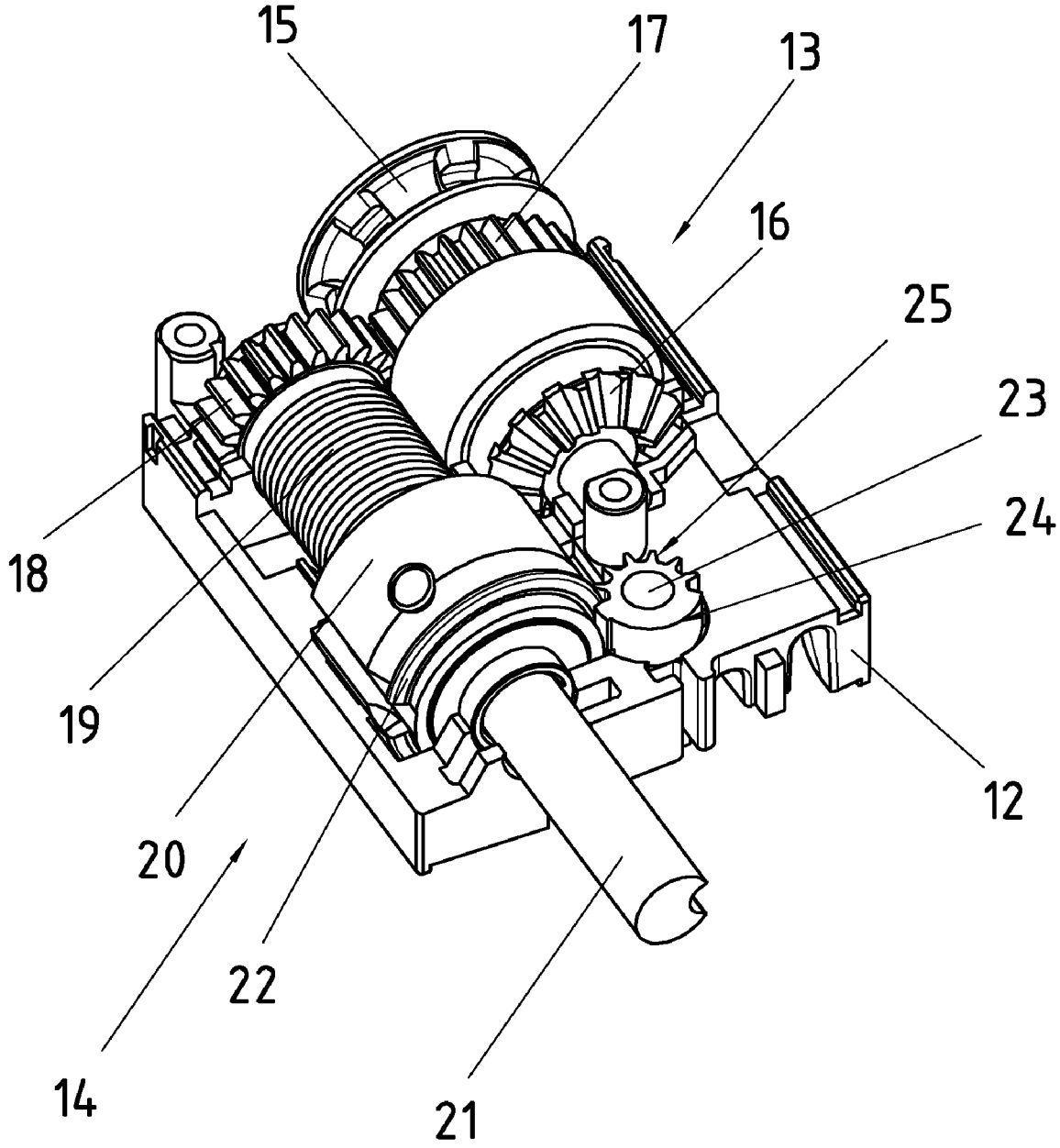
FIG. 2 is a perspective top view of the drive unit of FIG. 1 with removed upper housing part.

FIG. 2 shows a view of the drive unit 10 with the upper housing part removed. As can be clearly inferred from FIG. 2, the toothed ring section 25 has six teeth, so that six revolutions of the bushing 20 are possible. In the respective end positions, a front surface of the spiral 22 in each case stops at the stop element 24 in the known manner.

Figure 3:
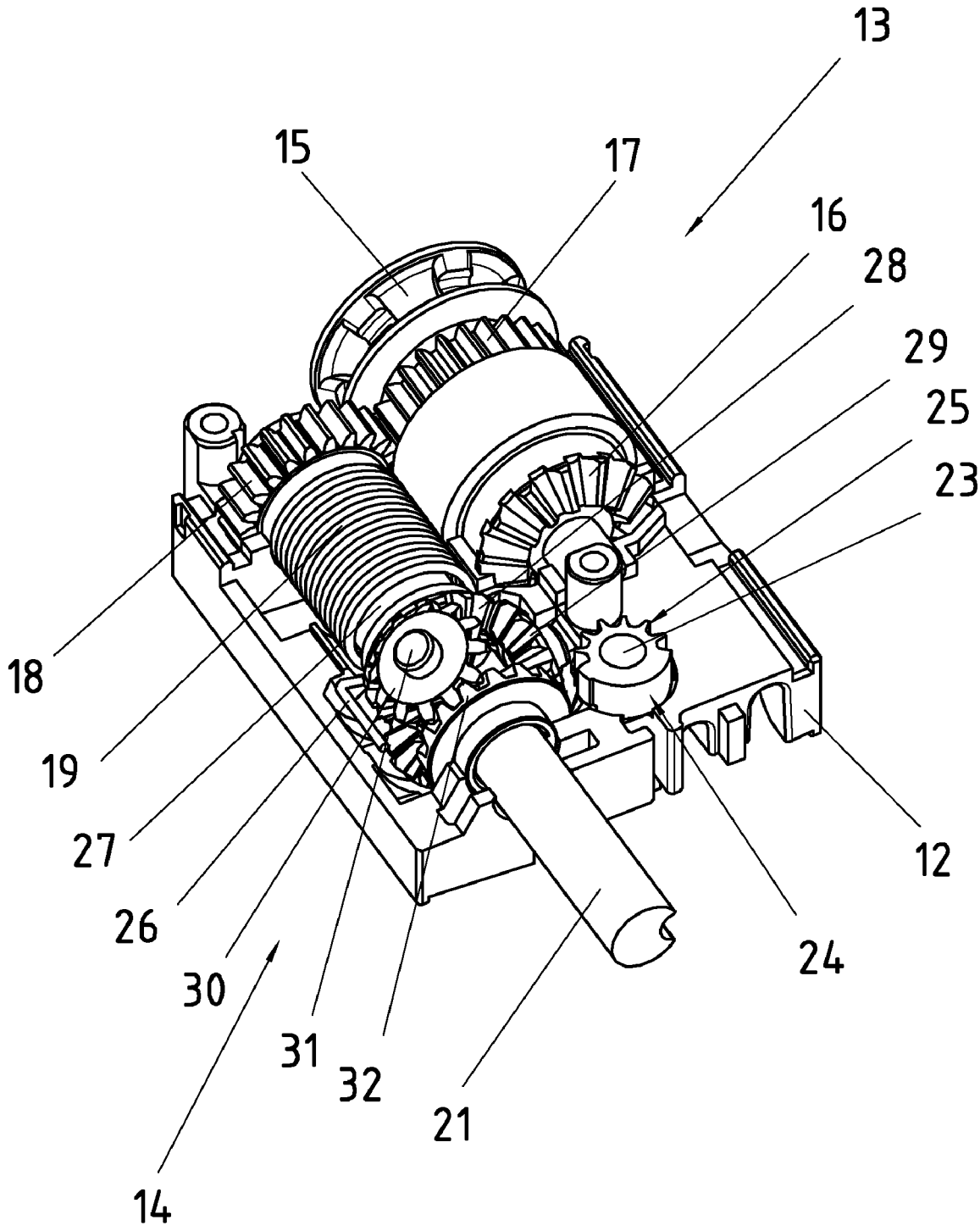
FIG. 3 is a view similar to FIG. 2 with partly disassembled other differential gear.

FIG. 3 shows a view similar to FIG. 2, whereby the bushing 20 is removed from the differential gear 14. As can be inferred from FIG. 3, the leg spring 19 has a leg 26, which meshes with the bushing 20 in the mounted state. Moreover, it can be recognized in FIG. 3 that the toothed wheel 18 is connected by means of a sleeve 27 to a bevel gear 28 of the differential gear 14 in a manner adapted to rotate in unison. The leg spring 19 is arranged on the sleeve 27, and a leg of the leg spring turned away from the leg 26 is connected to the toothed wheel 18 in a manner adapted to rotate in unison.

As can be further inferred from FIG. 3, the differential gear has, besides the bevel gear 28, two other bevel gears 29, 30, which are each mounted rotatably at the bushing 20 by means of axles 31. Each of the bevel gears 29, 30 meshes on one side with the bevel gear 28 and at the end turned away from same with another bevel gear 32, which forms the other first driven element of the differential gear 14. The bevel gear 32 is connected to the spline shaft 21 in a manner adapted to rotate in unison.

Figure 4:
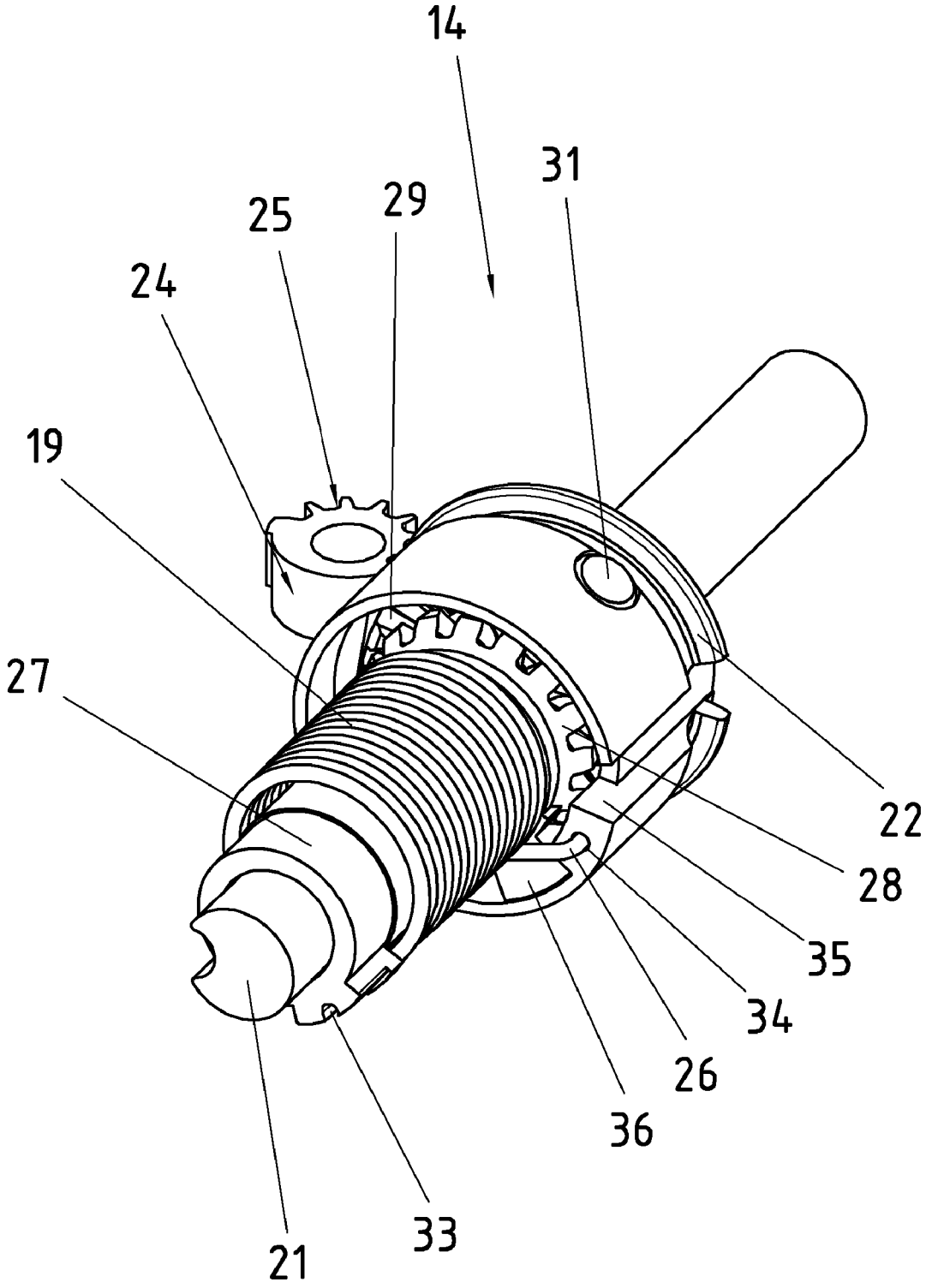
FIG. 4 is a schematic view of the other differential gear in a lateral view for illustrating the stopping function.

FIG. 4 shows the differential gear 14 in a lateral view, as viewed from the toothed wheel 18. As can be inferred from FIG. 4, the sleeve 27 has a mount 33 for a leg at the end of the leg spring 19 turned away from the leg 26. Another mount 34 is arranged at the bushing 20 and meshes with the leg 26. The bushing 20 has, moreover, a stop 35, which, in the exemplary embodiment shown, is a thickened section with rectangular cross section, in the middle of which the mount 34 is formed as a blind hole. Moreover, as can be inferred from FIG. 4, a stop 36 is arranged at the bevel gear 28, which interacts with the stop 35. In the exemplary embodiment shown, the leg spring 19 is pretensioned in such a way that the stops 35, 36 are held against one another in the position shown.

Figure 5:
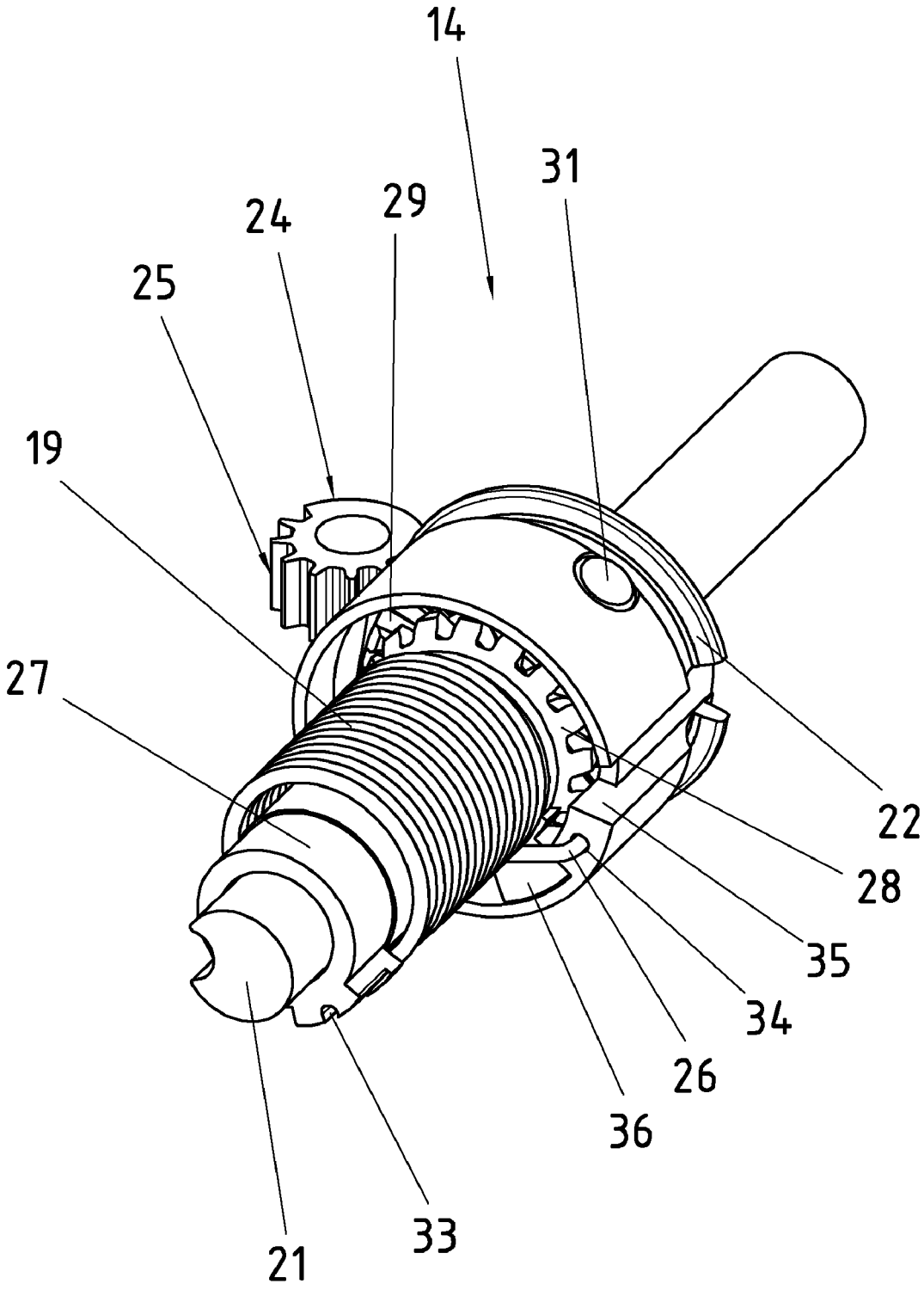
FIG. 5 is a view similar to FIG. 4 in a state for achieving another completely closed, rotated position of the vertical slats.
Figure 6:
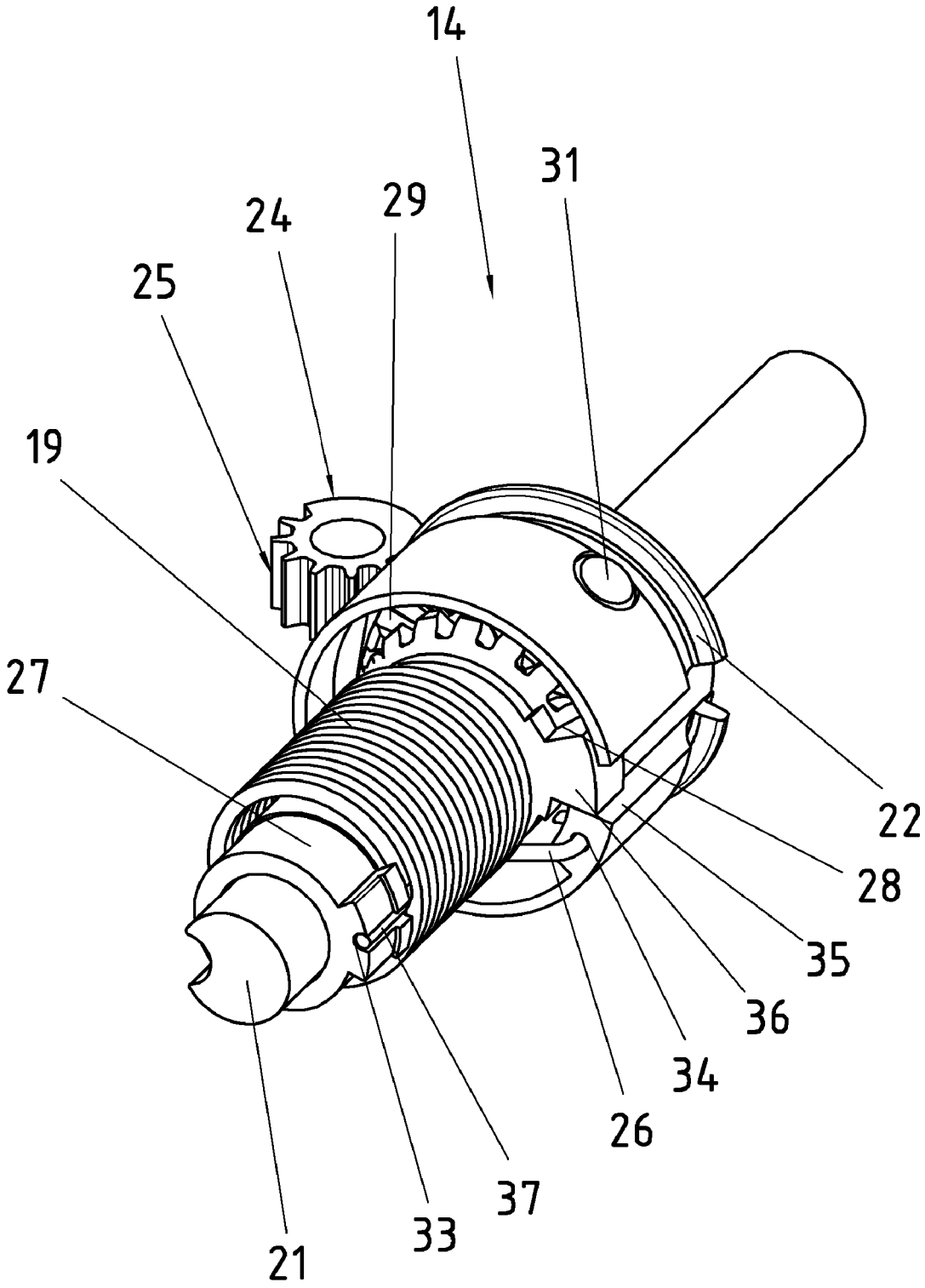
FIG. 6 is a view similar to FIGS. 4 and 5 of a state for again achieving a partly open rotated position for displacing the vertical slats.

FIG. 5 and FIG. 6 each show a view similar to FIG. 4, wherein a leg 37 of the leg spring 19 arranged in the mount 33 is shown, moreover, in FIG. 6.

The mode of operation of the drive unit 10 is explained in detail below on the basis of FIGS. 1 through 6. For closing a completely open vertical Venetian blind, the chain wheel 15 is actuated by means of a ball chain not shown in the figures. In the completely open state of the vertical Venetian blind, the differential gear 14 is in the state shown in FIG. 6, in which the stop element 24 stops at a front end of the spiral 22 and the stop 36 in FIG. 6 comes into contact with the stop 35 from above. Here the leg spring 19 is tensioned by one revolution. Since the displacing motion of the vertical slats is tighter than the rotation motion thereof, the toothed wheel 18 is now first driven via the outer ring 17 when the chain wheel 15 is actuated. At first the stop 36 is brought into the position under the stop 35 shown in FIG. 5, while the leg spring 19 is released. The vertical slats are then brought into a closed position by means of driving the spline shaft 21 via the bevel gears 28, 29, 30, 32 from an approximately 30° open position with stationary bushing 20. With further actuation of the chain wheel 15, the bushing 20 is rotated over the stop 36 and the stop 35 to the extent that the stop element 24 is located in its opposite stop positions compared to FIGS. 5 and 6 and the spiral 22 stops at its other front end at the stop element 24. The vertical slats are then rotated into their closed, final position. With another actuation of the chain wheel 15, the bevel gear 16 is driven because of the now blocked toothed wheel 18 and thus also because of the blocked toothed wheel 17. The bevel gear 16 meshes with a driving gear for a pull cord for displacing the vertical slats. With a further actuation of the chain wheel 15, the vertical slats are then displaced into their completely closed, final position.

If now the vertical slats shall be rotated out of the extended position for the complete closing in the opposite direction because of an unfavorable angle of incidence, then the chain wheel 15 is actuated in the opposite direction. The vertical slats are rotated here in the opposite direction by the sleeve 20 being rotated by means of actuating the toothed wheel 18 via the outer ring 17 by means of the spring force of the leg spring 19 to the extent that the stop element 24 has been rotated from the position shown in FIG. 4 into the position shown in FIG. 5.

For opening the vertical Venetian blind, the chain wheel 15 can be further actuated in the same direction. Because the spiral 22 stops at the stop element 24 and thus prevents a further rotation of the bushing 20, the bevel gear 28 can be rotated one revolution further against the bushing 20 while tensioning the leg spring 19 until the stop 36 comes to lie at the stop 35 as shown in FIG. 6 from above. Because the bevel gear 28 meshes with the bevel gears 29, 30, the rotary motion of the bevel gear 28 is converted via the bevel gears 29, 30 to the bevel gear 32 into a rotary motion of same in the opposite direction. The vertical slats are rotated by means of the spline shaft 21 for an opening into an approximately 30° opened position. A further actuation of the chain wheel 15 then leads to a displacing of the vertical slats via the bevel gear 16 for opening the vertical Venetian blind because of the differential gear 14, which is now blocked in this position. Because of the approximately 30° opened position of the vertical slats, they cannot get hooked up when brought together into a pack.

Figure 7:
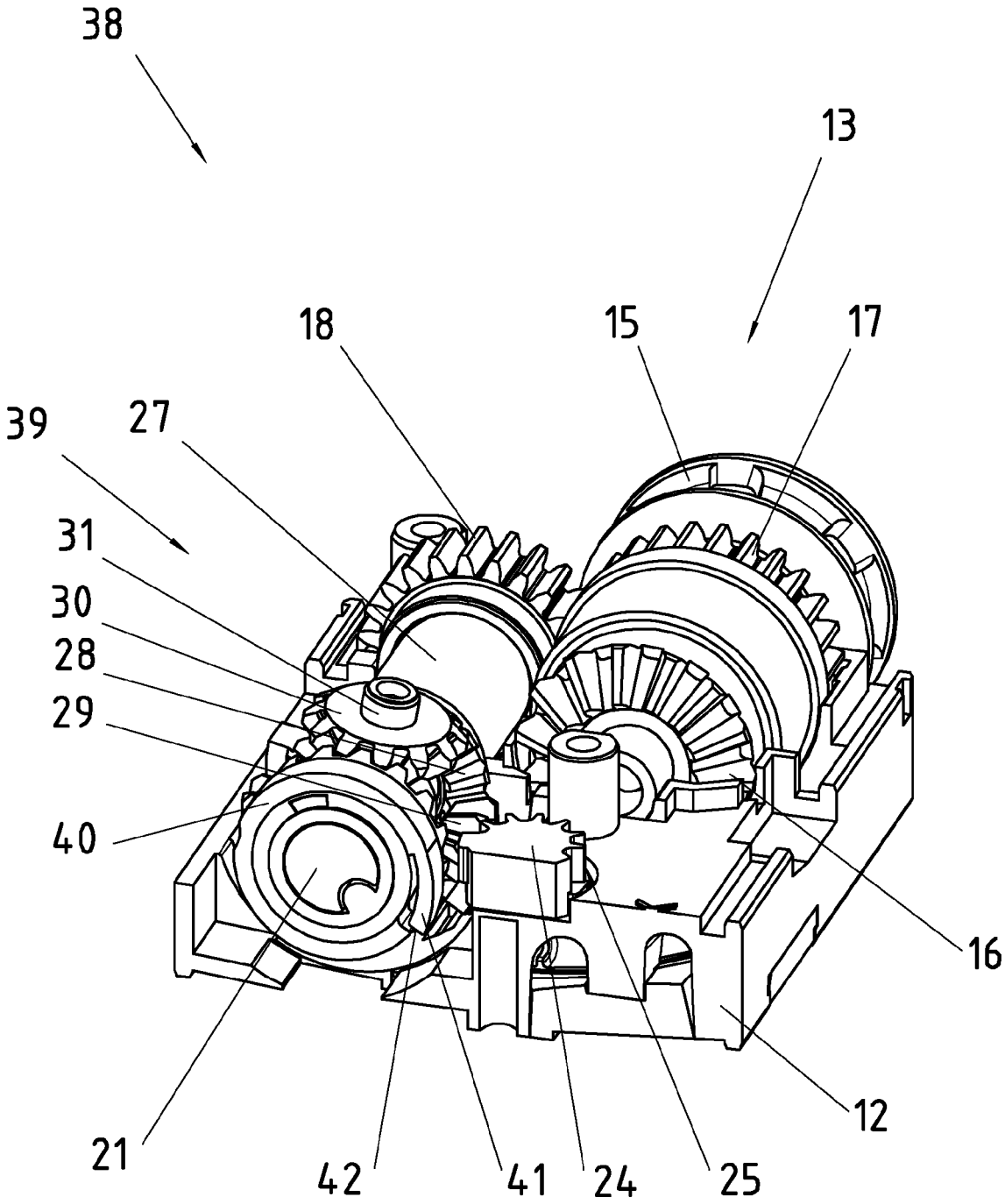
FIG. 7 is a schematic view of a drive unit with removed upper housing part as another exemplary embodiment of the present invention.

FIG. 7 shows a schematic view of a drive unit 38 as another exemplary embodiment of the present invention. The drive unit 38 essentially corresponds to the drive unit 10. Identical elements have the same reference numbers. Unlike the drive unit 10, the drive unit 38 has another differential gear 39. In the differential gear shown, the other differential gear is likewise a differential gear 39. The other differential gear 39 essentially corresponds to the other differential gear 14. However, the other differential gear 39 does not have a leg spring 19.

For better overall view, FIG. 7 does not show the housing of the other differential gear 39. As can be inferred from FIG. 7, the other differential gear 39 has a bevel gear 40 instead of the bevel gear 32. Unlike the bevel gear 32, a part of the outer circumference of the bevel gear 40 is embodied as a spring section 41. The spring section 41 protrudes a little bit over the outer circumference of the remaining circumference of the bevel gear 40. In particular, the spring section 41 is pretensioned radially in the outward direction. In FIG. 7, the spring section 41 has a front surface 42 at the lower end.

Figure 8:
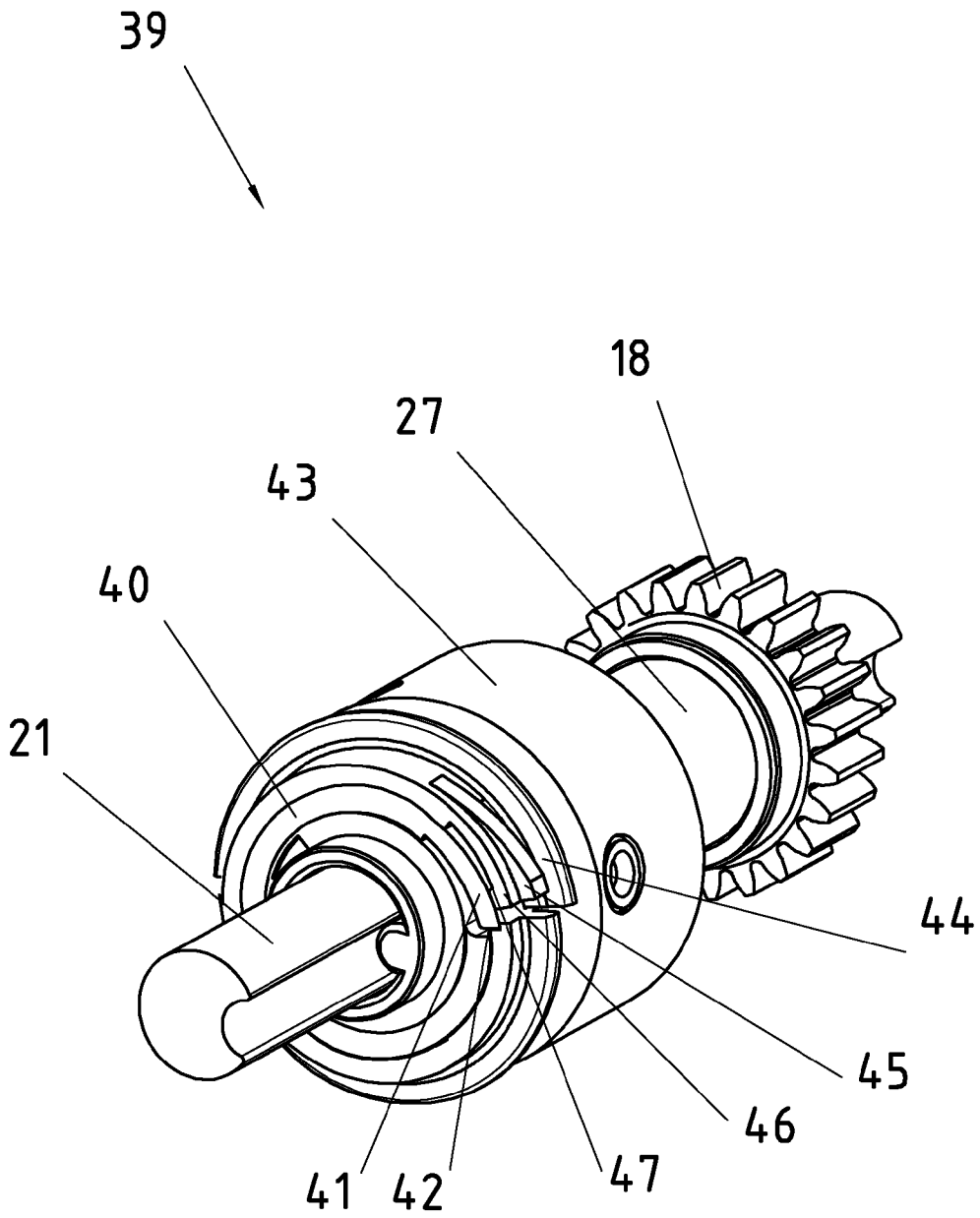
FIG. 8 is a schematic view of another embodiment of another differential gear.

FIG. 8 shows a perspective view of the differential gear 39. The differential gear 39 has a bushing 43, similar to the bushing 20, as a housing. The bushing 43 likewise has a spiral 44 similar to the spiral 22 as the other second driven element. Unlike in the spiral 22, the spiral 44 has, however, more than one turn. In particular, a second turn section 45, which is arranged on a spring section 46, is connected to the first turn of the spiral 44. In the normal state, the spring section 46 is embodied as a continuation of the circumference of the bushing 43 in the area of the spiral 44. On its side turned away from the second turn section 45, the spring section 46 has a web 47.

Figure 9:
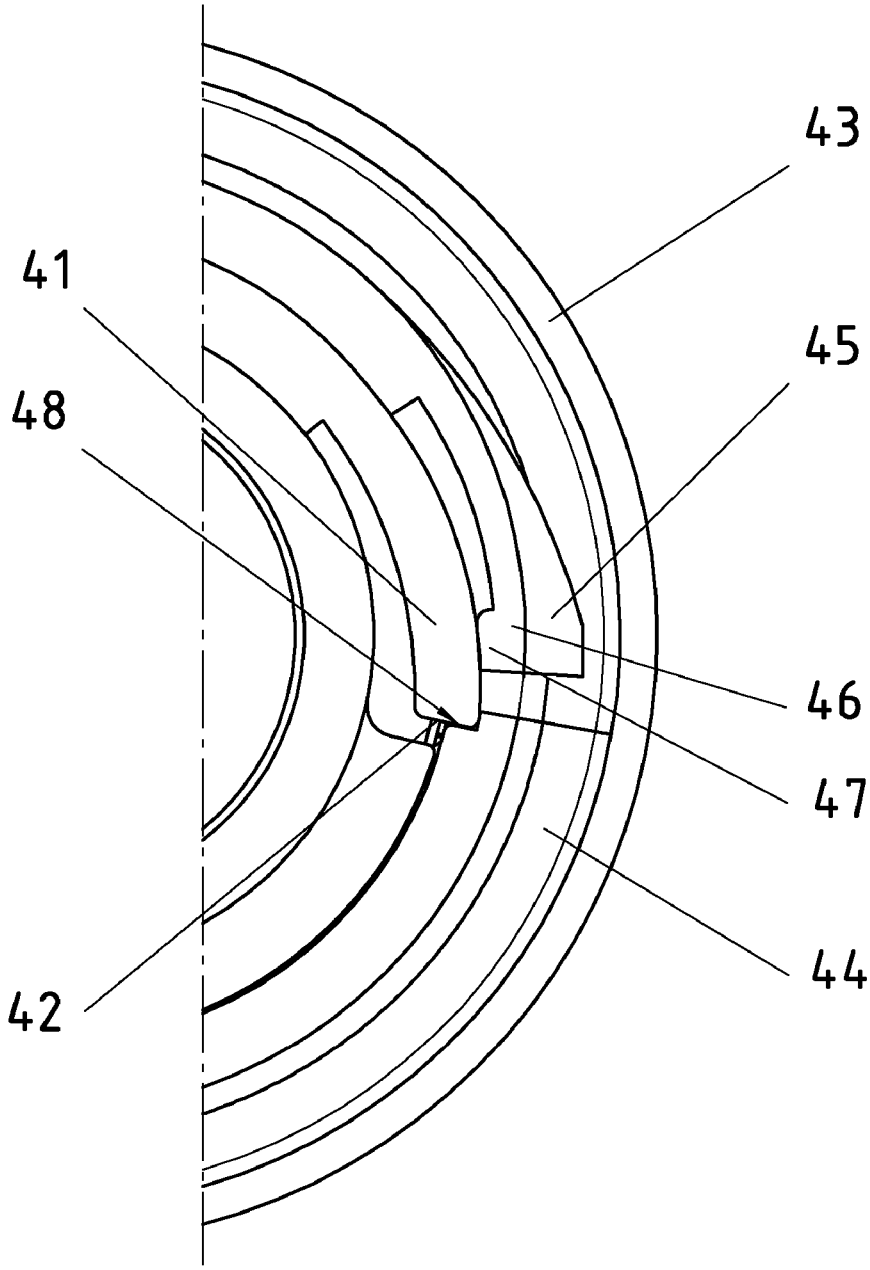
FIG. 9 is an enlarged partial view of a front surface of the other differential gear.

FIG. 9 shows an enlarged partial view of the front side of the bushing 43. As can be inferred from FIG. 9, a mount, which is turned towards the web 47 and is assigned to the spiral 44, for the front surface 42 of the spring section 41, is arranged at the bushing 43. In the state shown, the front surface 42 actively meshes with the mount 48, so that a coupled state of the snap-in coupling is produced. In particular, the bevel gear 40 and the bushing 43 and thus the spiral 44 are connected by means of the front surface 42 and the mount 48 to one another in a manner adapted to rotate in unison.

Figure 10:
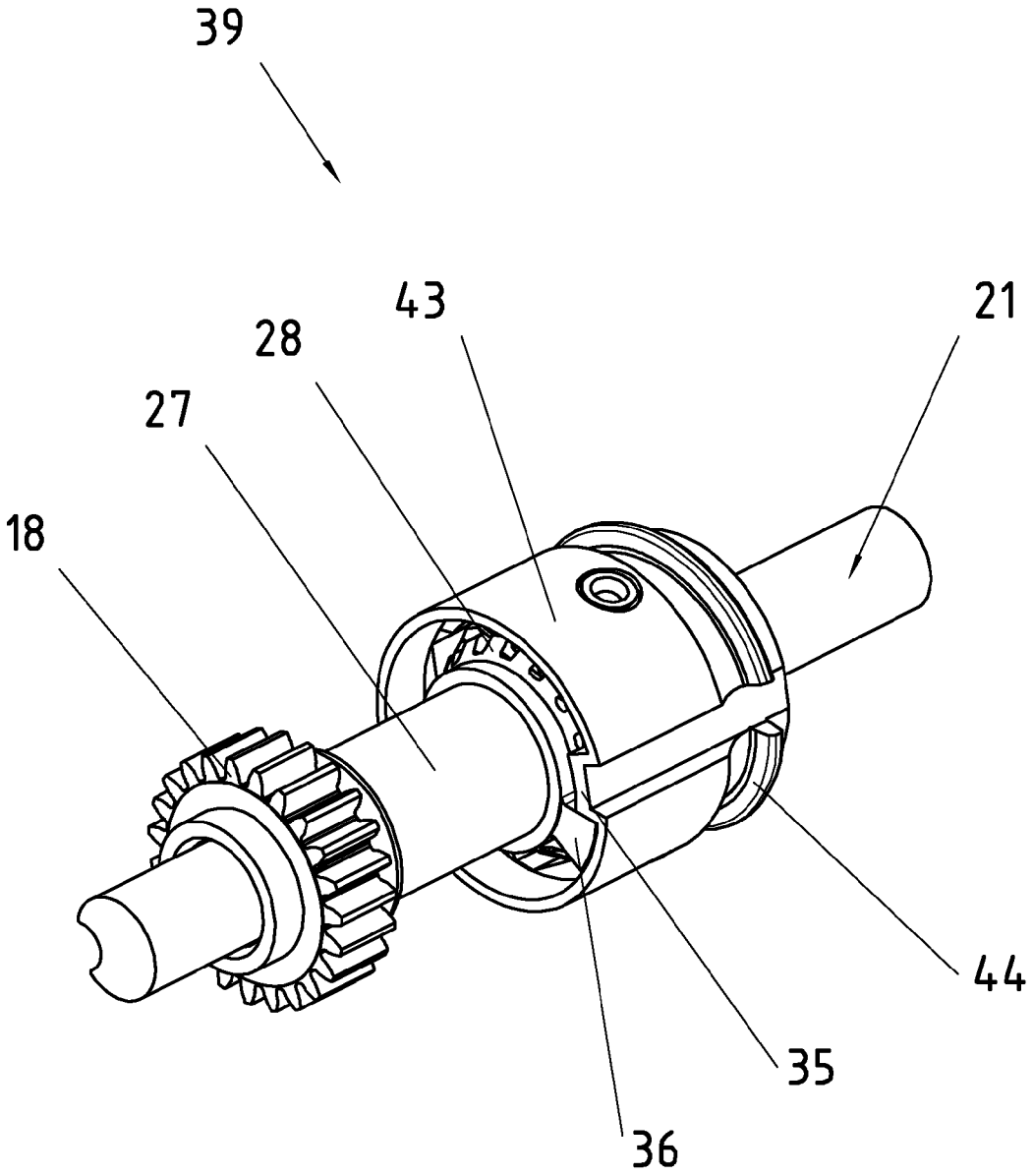
FIG. 10 is a schematic rear view of the other differential gear of FIG. 8.
Figure 11:
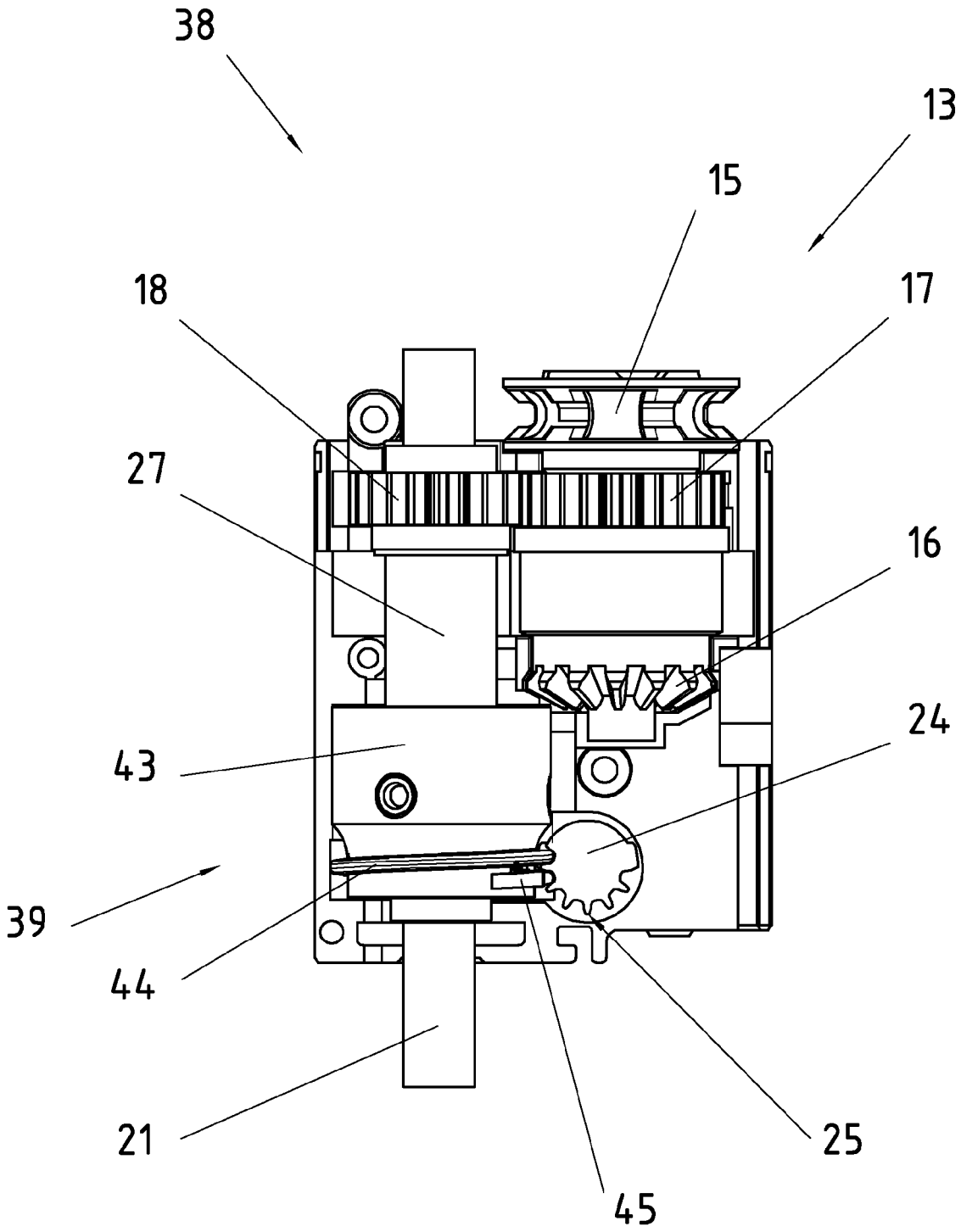
FIG. 11 is a top view of the drive unit of FIG. 7.
Figure 12:
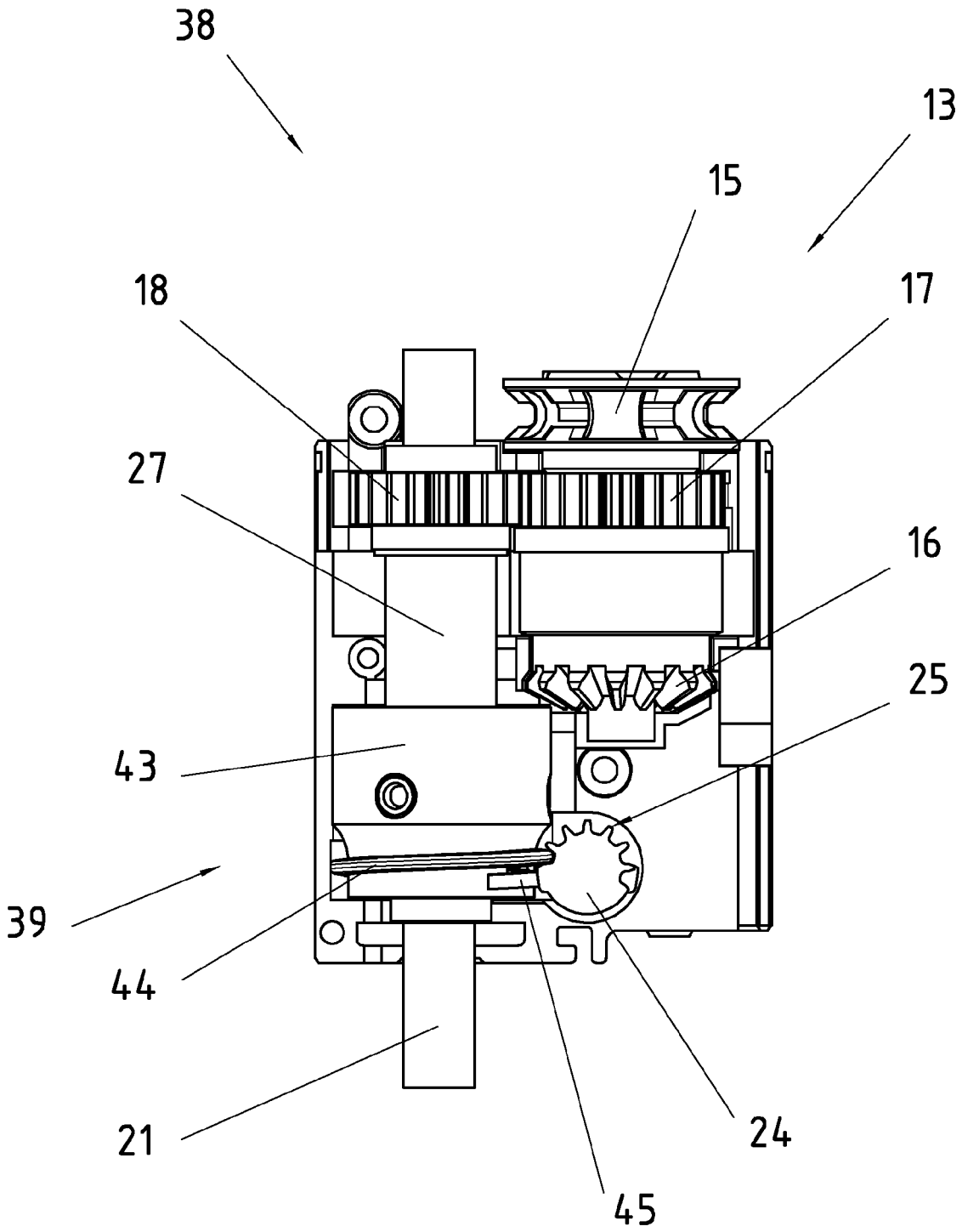
FIG. 12 is a view similar to FIG. 11 in a released state of the snap-in coupling.

FIG. 10 shows a perspective rear view of the differential gear 39 similar to the view of FIG. 4. FIG. 11 shows a top view of the drive unit 38 in a coupled state and FIG. 12 shows a top view of the drive unit 38 in a released state of the coupling.

The mode of operation of the drive unit 38 is explained in detail below on the basis of FIGS. 7 through 12. The mode of operation essentially corresponds to that of the drive unit 10. A different mode of operation arises when turning the vertical slats for complete closing in the opposite direction in the extended position. In the completely closed position reached during the extension, the spring section 41 actively meshes with the mount 48, as shown in FIG. 9. At the same time, the stop 36, as shown in FIG. 10, stops at the stop 35 from below, and a front end of the spiral 44 abuts against the stop element 24, as shown in FIG. 11. If because of an unfavorable angle of incidence the vertical slat shall now be turned in a position extended in the opposite direction for the complete closing, then the chain wheel 15 is actuated in the opposite direction. Here, the vertical slats are rotated in the opposite direction by the sleeve 43 being rotated by means of actuating the toothed wheel 18 via the outer ring 17 by the active meshing of the spring section 41 and of the mount 48 to the extent that the stop element 24 has been rotated from the position shown in FIG. 11 into the position shown in FIG. 12. In this state, the vertical slats are completely closed in the opposite direction. For opening the vertical Venetian blind, the chain wheel 15 can now be further actuated in the same direction as for rotating. Because the stop 24 now presses the spring section 46 in FIG. 9 radially in the inward direction via the second turn section 45, the spring section 41 is pressed via the web 47 radially inwardly to the extent that the front surface 42 no longer meshes with the mount 48. With a further actuation of the chain wheel 15, the bushing 43 cannot be further rotated counterclockwise in FIGS. 8 and 9 because of the stopping of the spiral 44 at the stop element 24. However, because the spring section 41 no longer meshes with the mount 48 in this state, the toothed wheel 18 can be further rotated by one revolution until it lies on the stop 35 from above in FIG. 10 after one clockwise rotation of the stop 36. However, because the bevel gear 28 meshes with the bevel gears 29 and 30, the rotary motion of the bevel gear 28 in FIG. 7 in the counterclockwise direction is converted into a clockwise rotary motion of the bevel gear 40. In this case, the spring section 41 slides along on the inner circumference surface of the bushing 43 under the spiral 44. With this clockwise rotation of the bevel gear 40 in FIGS. 7 and 8, the vertical slats are rotated by means of the spline shaft 21 for opening into an approximately 30° opened position. Because of the differential gear 39 being blocked in this position, a further actuation of the chain wheel 15 then leads to a displacing of the vertical slats by means of the bevel gear 16 for opening the vertical Venetian blind. Because of the approximately 30° opened position of the vertical slats, they cannot get hooked up when being brought together into a pack. The mode of operation of the drive unit 38 is thus similar to that of the drive unit 10, and the opening by approximately 30° before bringing together into a pack does not take place against the spring 19, but rather essentially without additional forces after the front surface is no longer meshing with the mount 48.

While specific embodiments of the invention have been shown and described in detail to illustrate the application of the principles of the invention, it will be understood that the invention may be embodied otherwise without departing from such principles.

LIST OF REFERENCE NUMBERS

10 Drive unit
11 Upper housing part
12 Lower housing part
13 Planet gear
14 Differential gear
15 Chain wheel
16 Bevel gear
17 Outer ring
18 Toothed wheel
19 Leg spring
20 Bushing
21 Spline shaft
22 Spiral
23 Axle
24 Stop element
25 Toothed ring section
26 Leg
27 Sleeve
28 Bevel gear
29 Bevel gear
30 Bevel gear
31 Axle
32 Bevel gear
33 Mount
34 Mount
35 Stop
36 Stop
37 Leg
38 Drive unit
39 Differential gear
40 Bevel gear
41 Spring section
42 Front surface
43 Bushing
44 Spiral
45 Second spiral section
46 Spring section
47 Web
48 Mount

What is claimed is:

1. A vertical Venetian blind drive unit for a vertical Venetian blind having vertical slats, the drive unit comprising:

a shared driving element for the displacing motion and the rotating motion of vertical slats;

a first drive means for the rotating motion of the vertical slats;

a second drive means for the displacing motion of the vertical slats;

a differential gear with a driving element coupled to said shared driving element, and with a first driven element coupled to said first drive means, and with a second driven element coupled to said second drive means for the displacing motion of the vertical slats;

another differential gear inserted between said first driven element and said first drive means for rotating motion, said another differential gear having another driving element, another first driven element and another second driven element, said another driving element being coupled to said first driven element, and said another first driven element being coupled to said first drive means for the rotating motion.

2. A vertical Venetian blind drive unit in accordance with claim 1, further comprising limiting means assigned to said another second driven element for limiting the motion of said another second driven element.

3. A vertical Venetian blind drive unit in accordance with claim 2, wherein said limiting means has a spiral at said another second driven element and a worm gear assigned to same, said spiral and said worm gear together forming a stop for limiting the motion of said another second driven element.

4. A vertical Venetian blind drive unit in accordance with claim 2, wherein said limiting means limits the rotating range of the vertical slats to 180°.

5. A vertical Venetian blind drive unit in accordance with claim 1, further comprising another limiting means assigned to said another driving element for limiting relative motion between said another driving element and said another second driven element.

6. A vertical Venetian blind drive unit in accordance with claim 5, wherein said another limiting means has another stop each at said another driving element and said another second driven element.

7. A vertical Venetian blind drive unit in accordance with claim 6, wherein the relative motion between said another driving element and said another second driven element is limited to one revolution by means of said another stops.

8. A vertical Venetian blind drive unit in accordance with claim 1, wherein said another driving element is detachably connected to said another second driven element by means of a snap-in coupling.

9. A vertical Venetian blind drive unit in accordance with claim 8, wherein the snap-in coupling has a radially pretensioned spring section at said another first driven element, which can be released from a coupling position with a release element assigned to said another second driven element.

10. A vertical Venetian blind drive unit in accordance with claim 9, wherein said spring section actively meshes in the coupling position with a mount assigned to said another second driven element.

11. A vertical Venetian blind drive unit in accordance with claim 10, wherein a section connecting to said spiral is driven by means of a worm gear when the stop is reached for actuating said release element.

12. A vertical Venetian blind drive unit in accordance with claim 1, wherein said first drive means for the rotating motion of the vertical slats has a spline shaft connected in a manner adapted to rotate in unison with said another first driven element.

13. A vertical Venetian blind drive unit in accordance with claim 1, wherein said differential gear is a spur planet gear or a bevel planet gear.

14. A vertical Venetian blind drive unit in accordance with claim 1, wherein said shared driving element actively meshes with a lengthwise extended endless pulling element.

15. A vertical Venetian blind drive unit in accordance with claim 14, wherein the shared driving element is a chain wheel and the pulling element is a ball chain.

16. A vertical Venetian blind drive unit in accordance with claim 1, wherein the differential gear is a planet gear with a central wheel connected in a manner adapted to rotate in unison with said shared driving element.

17. A vertical Venetian blind drive unit in accordance with claim 16, wherein said planet gear has an outer ring as a first driving element, which meshes with said another driving element.

18. A vertical Venetian blind drive unit in accordance with claim 1, wherein said second driven element is actively connected to a driving gear for a pull cord in the form of a ball chain, for displacing the vertical slats.

19. A vertical Venetian blind comprising:

vertical slats mounted for rotating motion and for displacing motion; and a vertical Venetian blind drive unit comprising a shared driving element for the displacing motion and the rotating motion of vertical slats, a first drive means for imparting the rotating motion to said vertical slats, a second drive means for imparting the displacing motion to said vertical slats, a differential gear with a driving element coupled to said shared driving element, and with a first driven element coupled to said first drive means, and with a second driven element coupled to said second drive means for the displacing motion of the vertical slats, and another differential gear inserted between said first driven element and said first drive means for rotating motion, said another differential gear having another driving element, another first driven element and another second driven element, said another driving element being coupled to said first driven element, and said another first driven element being coupled to said first drive means for the rotating motion.

20. A vertical Venetian blind drive unit for a vertical Venetian blind having vertical slats, the drive unit comprising:

a shared driving element for the displacing motion and the rotating motion of vertical slats;

a first drive means for the rotating motion of the vertical slats;

a second drive means for the displacing motion of the vertical slats;

a differential gear with a driving element coupled to said shared driving element, and with a first driven element coupled to said first drive means, and with a second driven element coupled to said second drive means for the displacing motion of the vertical slats, said differential gear being a spur planet gear or a bevel planet gear;

another differential gear inserted between said first driven element and said first drive means for rotating motion.

* * * * *